US009873997B2

(12) United States Patent
Van Es

(10) Patent No.: US 9,873,997 B2
(45) Date of Patent: Jan. 23, 2018

(54) VIBRATOR SYSTEM

(71) Applicant: Dieseko Group B.V., Sliedrecht (NL)

(72) Inventor: Jan Robert Van Es, Zoelen (NL)

(73) Assignee: DIESEKO GROUP B.V., Sliedrecht (NL)

( * ) Notice: Subject to any disclaimer, the term of this patent is extended or adjusted under 35 U.S.C. 154(b) by 489 days.

(21) Appl. No.: 14/677,561

(22) Filed: Apr. 2, 2015

(65) Prior Publication Data

US 2015/0211201 A1 Jul. 30, 2015

Related U.S. Application Data

(63) Continuation of application No. PCT/NL2013/050670, filed on Sep. 17, 2013.

(30) Foreign Application Priority Data

Oct. 2, 2012 (NL) ..... 2009558

(51) Int. Cl.
*E02D 7/18* (2006.01)
*B06B 1/18* (2006.01)

(52) U.S. Cl.
CPC ..... *E02D 7/18* (2013.01); *B06B 1/186* (2013.01)

(58) Field of Classification Search
CPC ..... E02D 7/18; B06B 1/186
USPC ..... 173/49; 175/55
See application file for complete search history.

(56) References Cited

U.S. PATENT DOCUMENTS 4,143,719 A * 3/1979 Furukawa ..... E02D 7/18 173/1
5,263,544 A * 11/1993 White ..... E02D 11/00 173/162.1
5,355,964 A * 10/1994 White ..... E02D 7/18 173/1
5,653,556 A * 8/1997 White ..... E02D 7/18 173/162.1
5,988,297 A * 11/1999 Zimmerman ..... B06B 1/16 173/1
6,302,222 B1 * 10/2001 Vessat ..... E02D 13/02 173/49
6,386,295 B1 * 5/2002 Suver ..... E02D 7/18 173/1

(Continued)

FOREIGN PATENT DOCUMENTS

WO 2014/054942 4/2014

*Primary Examiner* — Michelle Lopez
(74) *Attorney, Agent, or Firm* — Peacock Myers, P.C.; Jeffrey Myers

(57) ABSTRACT

A vibrator-system for sinking an object into the ground by means of vibration, comprises a suspension yoke, a carter or carters mounted to the suspension yoke and equipped with a rotatable eccentric weight or weights for the generation of the vibration, and clamping means connected at a side of the carter or carters that is opposite to the suspension yoke for clamping the object, wherein the vibrator system is convertible between a first configuration and a second configuration, wherein in the first configuration a single carter is mounted to the suspension yoke and the clamping means are mounted to the single carter, and that in the second configuration two carters, each equipped with a rotatable eccentric weight or weights, are mounted between the suspension yoke and the clamping means.

6 Claims, 5 Drawing Sheets

(56) References Cited

U.S. PATENT DOCUMENTS

| | | | | |
|---|---|---|---|---|
| 6,431,795 | B2 * | 8/2002 | White | E02D 11/00 175/55 |
| 6,648,556 | B1 * | 11/2003 | White | E02D 7/18 175/171 |
| 6,860,338 | B2 * | 3/2005 | Salesse | B66C 13/04 173/44 |
| 7,913,771 | B2 * | 3/2011 | White | E02D 7/18 173/194 |
| 8,425,157 | B1 * | 4/2013 | Goranson | E02D 13/02 405/232 |

* cited by examiner

VIBRATOR SYSTEM

CROSS-REFERENCE TO RELATED APPLICATIONS

This application is a continuation application of Patent Cooperation Treaty Application No. PCT/NL2013/050670, entitled "Vibrator-system", filed on Sep. 17, 2013, which claims priority to Netherlands Patent Application No. 2009558, filed on Oct. 2, 2012, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention (Technical Field)

The present invention relates to a vibrator-system for sinking an object into the ground by means of vibration.

Description of Related Art

The invention relates to a vibrator-system for sinking an object into the ground by means of vibration, comprising a suspension yoke, a carter or carters mounted to the suspension yoke and equipped with a rotatable eccentric weight or weights for the generation of the vibration, and clamping means connected at a side of the carter or carters that is opposite to the suspension yoke for clamping the object.

Such a vibrator system is known from the Dutch pa-tent NL-A-2002804. In this known vibrator system a series of carters are placed in series next to each other in order to drive a tubular construction into the ground.

BRIEF SUMMARY OF THE INVENTION

It is an object of the invention to provide a vibrator system that is flexible and can be easily and at low cost attuned to the power requirements needed for driving an object into the ground.

The vibrator system of the invention is therefore provided with the features of one or more of the appended claims.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1A:
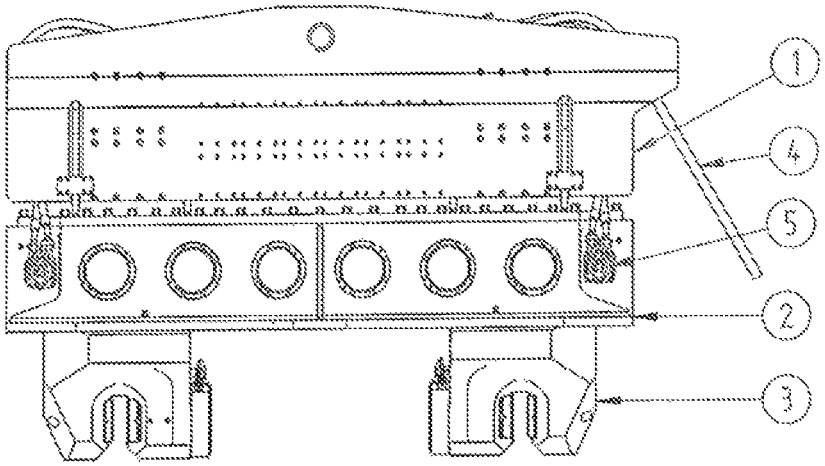
FIGS. 1A and 1B are a side view and isometric view of a vibrator system of the invention in a first configuration.

According to a first aspect of the invention the vibrator system is convertible between a first configuration and a second configuration, wherein in the first configuration a single carter is mounted to the suspension yoke and the clamping means are mounted to the single carter, and that in the second configuration two carters, each equipped with a rotatable eccentric weight or weights, are mounted between the suspension yoke and the clamping means. This is a cost-effective solution for simply and quickly magnifying the power of the vibrator system.

Suitably in the second configuration the two carters are connected to each other with an interpositioned synchronization module for synchronizing the rotation of the eccentric weights in the two carters. This is preferably realized in that the synchronization module comprises at least a gear wheel contacting cooperating gear wheels connecting to the eccentric weights in each of the two carters.

The vibrator system of the invention can be realized particularly cost-effective by embodying the two carters to have identical dimensions. This can be further promoted by arranging that the carters have an identical number of eccentric weights.

Whenever in the figures the same reference numerals are applied, these numerals refer to the same parts.

Figure 1B:
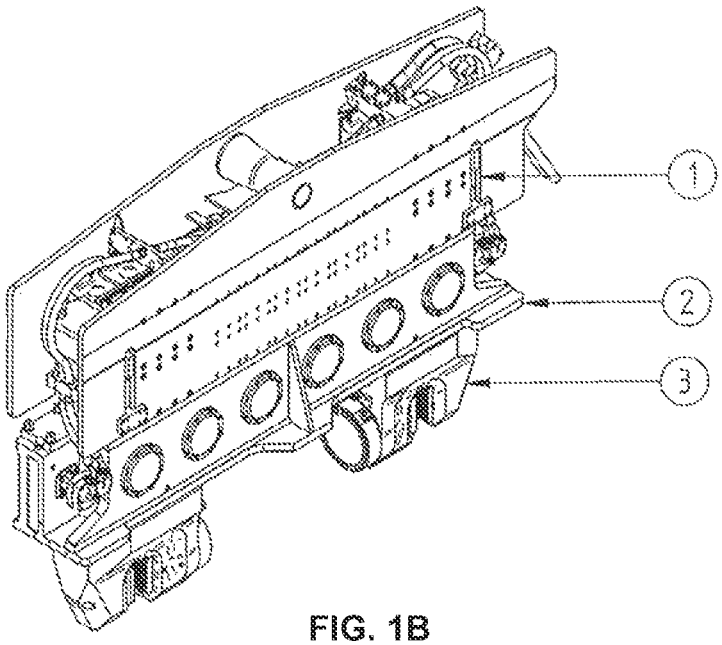
Figure 2A:
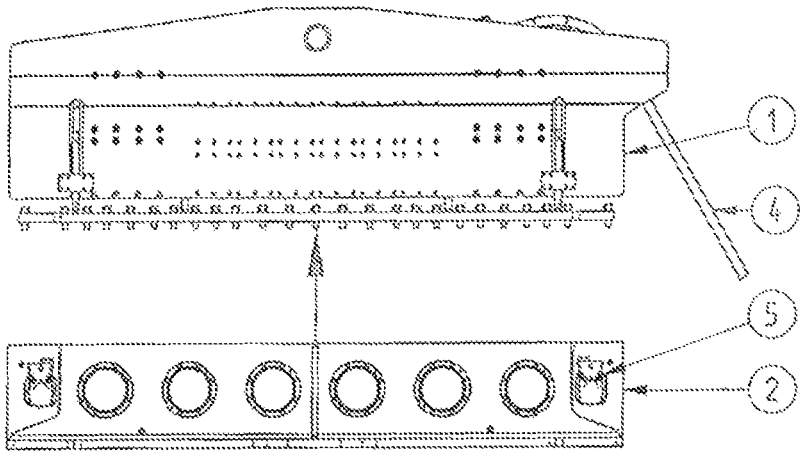
FIGS. 2A and 2B are an exploded side view and isometric view of parts of the vibrator system shown in FIG. 1.
Figure 2B:
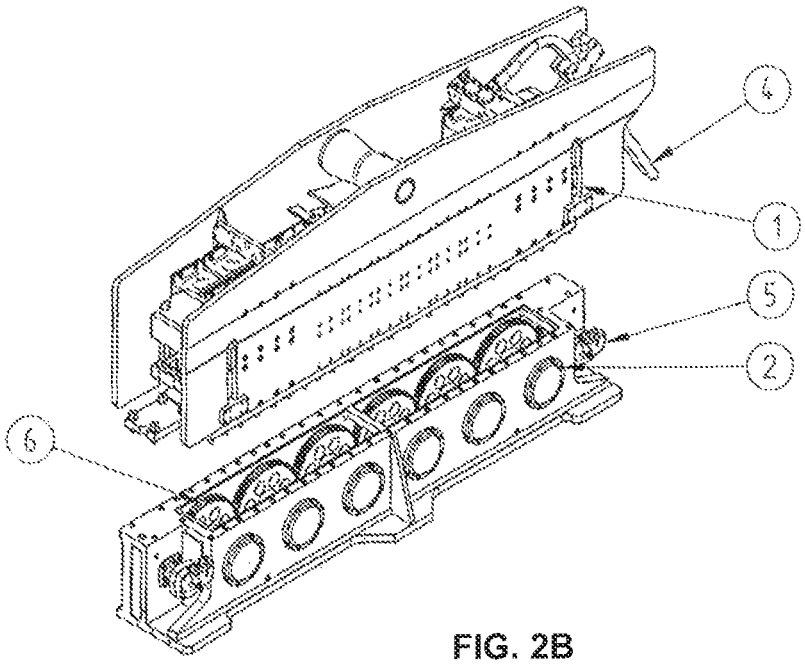

Referring first to FIG. 1 and FIG. 2, a side and isometric view of the vibrator system of the invention is shown in its first configuration. FIG. 1 shows the vibrator system as mounted; FIG. 2 shows the vibrator system in an exploded view. The vibrator system comprises in this first configuration a suspension yoke 1, a carter 2 mounted to the suspension yoke 1 and clamping means 3 connected at a side of the carter 2 that is opposite to the suspension yoke 1 for clamping the object that has to be driven into the ground. The carter 2 is equipped with a rotatable eccentric weight or weights for the generation of the required vibration. The eccentric weights are driven by a hydromotor 5 which receives its power fluid via fluid line 4. FIG. 2 further clearly shows the gear wheels 6 that drive the eccentric weights of the carter 2. In the drawing the hydromotor 5 drives the eccentric weights via a gear train. It is however also possible to drive the eccentric weights directly.

Figure 3A:
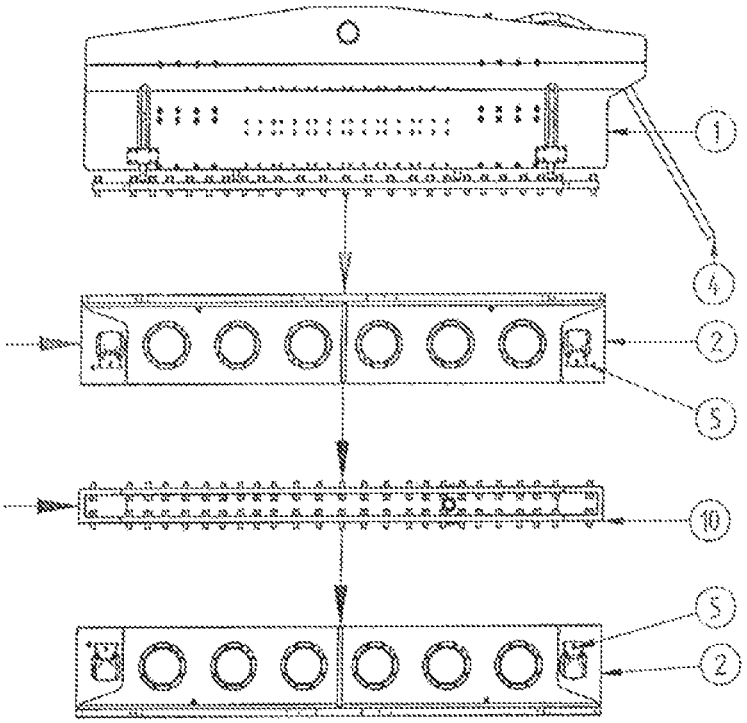
FIGS. 3A and 3B are an exploded side view and isometric view of parts of the vibrator system of the invention in a second configuration.
Figure 3B:
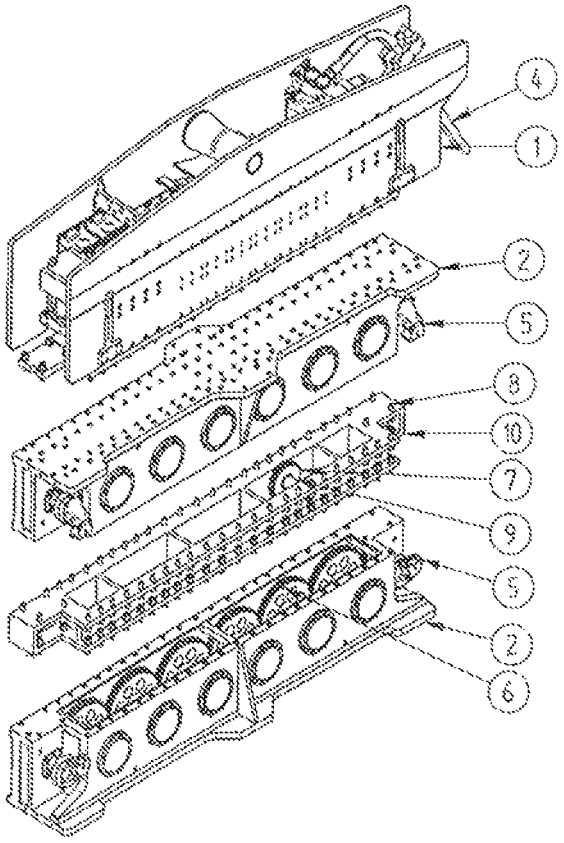
Figure 4A:
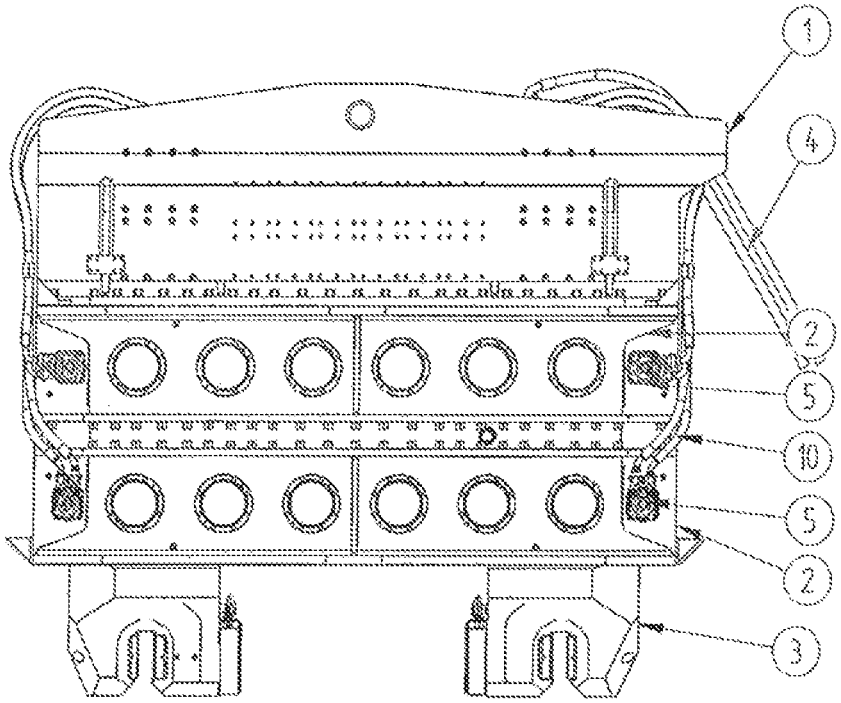
FIGS. 4A and 4B are a side view and isometric view of the vibrator system of the invention in the second configuration.
Figure 4B:
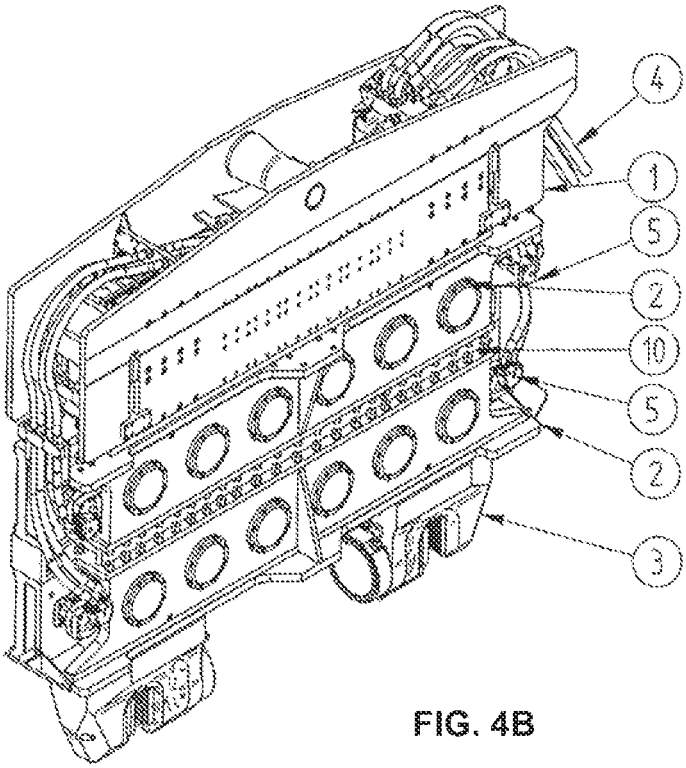
Figure 5:
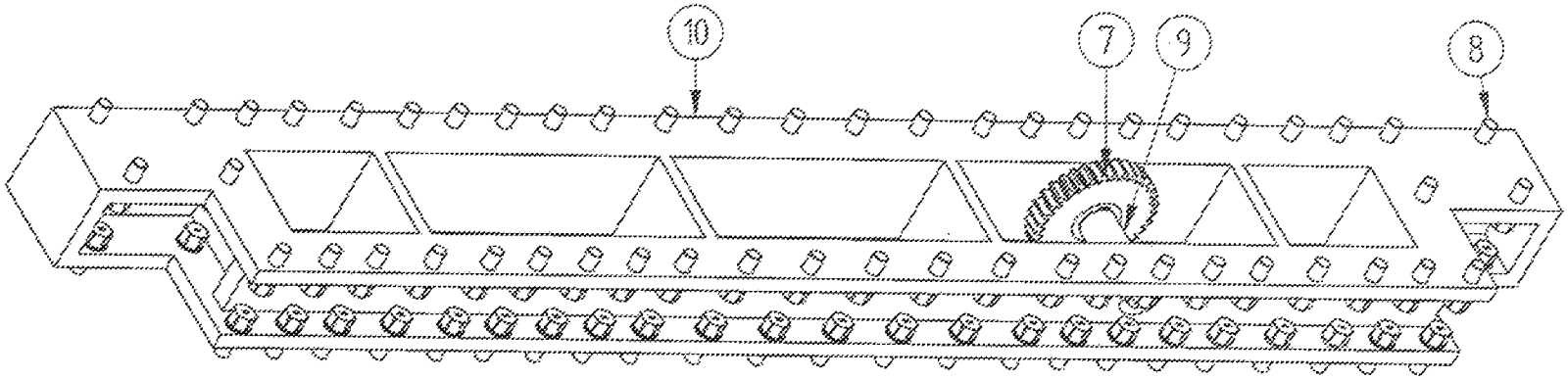
FIG. 5 is an isometric view of the synchronization module of the vibrator system of the invention.

The vibrator system of the invention is convertible between the first configuration shown with reference to FIG. 1 and FIG. 2, and a second configuration which is shown in FIG. 3 and FIG. 4. In the first configuration shown in FIGS. 1 and 2, a single carter 2 is mounted to the suspension yoke 1 and the clamping means 3 are mounted to the single carter 2. In the second configuration shown in FIGS. 3 and 4 two carters 2 are applied, wherein each carter 2 is equipped with a rotatable eccentric weight or weights, and both carters 2 are mounted between the suspension yoke 1 and the clamping means 3. In particular FIG. 3 clearly shows that in the second configuration the two carters 2 are connected to each other with an interpositioned synchronization module 10 for synchronizing the rotation of the eccentric weights of the two carters 2. The synchronization module 10 is separately shown in FIG. 5. It preferably comprises a gear wheel 7 (mounted on an axle 9) which is intended to contact cooperating gear wheels 6 (see FIG. 3) in each of the two carters 2 connecting to the eccentric weights in said carters. The gear wheel 7 of the interpositioned synchronization module 10 only needs to contact a single gear wheel 6 of each carter 2, since the gear wheels of the eccentric weights in any carter 2 are mutually connected and therefore synchronized.

To restrict the costs it is preferable that the two carters 2 have identical dimensions and they preferably also have an identical number of eccentric weights. Naturally in the second configuration of the vibrator system shown in FIGS. 3 and 4, the fluid lines 4 need to supply power fluid to the hydromotors 5 of both carters 2. With a view to a cost effective solution the two carters 2 are preferably not only provided with the same dimensions, but they are also mounted with the same sides to the interpositioned synchronization module 10. In other words: the sides of the carters 2 that are open to allow access to the carter's gear wheels 6 are connected to the synchronization module 10. Therefore, in comparison with each other one of the carters 2 is placed upside down.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A vibrator-system for sinking an object into the ground by means of vibration, comprising a suspension yoke, a carter or carters mounted to the suspension yoke and equipped with a rotatable eccentric weight or weights for the generation of the vibration, and clamping means connected at a side of the carter or carters that is opposite to the suspension yoke for clamping the object, wherein the vibrator system is convertible between a first configuration and a second configuration, wherein in the first configuration a single carter is mounted to the suspension yoke and the clamping means are mounted to the single carter, and wherein in the second configuration two carters, each equipped with a rotatable eccentric weight or weights, are mounted between the suspension yoke and the clamping means.

2. The vibrator system according to claim 1, wherein in the second configuration the two carters are connected to each other with an interpositioned synchronization module for synchronizing the rotation of the eccentric weights in the two carters.

3. The vibrator system according to claim 2, wherein the synchronization module comprises at least a gear wheel contacting cooperating gear wheels connecting to the eccentric weights in each of the two carters.

4. The vibrator system according to claim 3, wherein the two carters have identical dimensions and/or an identical number of eccentric weights.

5. The vibrator system according to claim 2, wherein the two carters have identical dimensions and/or an identical number of eccentric weights.

6. The vibrator system according to claim 1, wherein the two carters have identical dimensions and/or an identical number of eccentric weights.

* * * * *